US010153538B2

(12) United States Patent
Kang et al.

(10) Patent No.: US 10,153,538 B2
(45) Date of Patent: Dec. 11, 2018

(54) ANTENNA WITH RADIATOR FIXED BY FUSION, AND MANUFACTURING METHOD THEREOF

(71) Applicant: Skycross, Inc., Fremont, CA (US)

(72) Inventors: Du Ho Kang, Gyeonggi-do (KR); Doo Hyung Lee, Gyeonggi-do (KR); Jae Nam Kim, Gyeonggi-do (KR); Jae Hong Park, Gyeonggi-do (KR)

(73) Assignee: Skycross Co., LTD. (KR)

( * ) Notice: Subject to any disclaimer, the term of this patent is extended or adjusted under 35 U.S.C. 154(b) by 0 days.

(21) Appl. No.: 14/263,621

(22) Filed: Apr. 28, 2014

(65) Prior Publication Data

US 2015/0270612 A1 Sep. 24, 2015

(30) Foreign Application Priority Data

Mar. 20, 2014 (KR) ..... 10-2014-0032916

(51) Int. Cl.

| | |
|---|---|
| ***H01Q 1/24*** | (2006.01) |
| ***H01Q 9/04*** | (2006.01) |
| ***H01Q 1/12*** | (2006.01) |
| ***H01Q 1/38*** | (2006.01) |
| ***H01Q 9/42*** | (2006.01) |

(52) U.S. Cl.

CPC ..... *H01Q 1/243* (2013.01); *H01Q 1/1207* (2013.01); *H01Q 1/241* (2013.01); *H01Q 1/38* (2013.01); *H01Q 9/0407* (2013.01); *H01Q 9/42* (2013.01); *Y10T 29/49016* (2015.01)

(58) Field of Classification Search

CPC .... H01Q 1/241; H01Q 9/0407; H01Q 1/1207; H01Q 1/38; H01Q 9/42; H01R 13/627; H01R 13/6278

USPC ..... 343/702, 872

See application file for complete search history.

(56) References Cited

U.S. PATENT DOCUMENTS 6,140,966 A * 10/2000 Pankinaho ..... H01Q 1/243 343/700 MS
6,295,036 B1 * 9/2001 Mata ..... E04B 9/006 343/878
7,151,493 B2 * 12/2006 Wen ..... H01Q 1/24 343/700 MS (Continued)

FOREIGN PATENT DOCUMENTS

KR 10-2011-0131619 12/2011
KR 20-2012-0001049 2/2012

*Primary Examiner* — Dameon E Levi
*Assistant Examiner* — Ab Salam Alkassim, Jr.
(74) *Attorney, Agent, or Firm* — Schott, P.C.

(57) ABSTRACT

An antenna with a radiator fixed by fusion and a method of manufacturing the same according to the present invention, since the metal radiator combined to the carrier having the stepped groove corresponding to the fusion projections and the 3D pattern of the metal radiator can be strongly fixed to the carrier with no gap through the fusion and combination of the fusion projections, the resin injected in the process of putting the combined radiator and carrier in a mold for injection of the external case and injecting the external case to cover the outer surfaces of the metal radiator and the carrier can be prevented from intruding between the carrier and the radiator, thereby preventing deviation and deformation of the metal radiator due to the penetration of the resin, achieving a high yield and providing uniform quality of the antenna.

19 Claims, 8 Drawing Sheets

(56) References Cited

U.S. PATENT DOCUMENTS 7,226,293 B2 * 6/2007 Na ..... H01Q 1/20 439/66
7,256,741 B2 * 8/2007 Wen ..... H01Q 1/243 343/700 MS
7,336,231 B2 * 2/2008 Hayashi ..... H01Q 1/1214 343/711
7,342,542 B2 * 3/2008 Sadamori ..... H01Q 1/243 343/702
7,369,089 B2 * 5/2008 Wen ..... H01Q 9/0421 343/700 MS
7,397,434 B2 * 7/2008 Mun ..... H01Q 1/243 343/700 MS
7,466,275 B2 * 12/2008 Cheng ..... H01Q 1/243 343/702
7,570,218 B2 * 8/2009 Tsujimura ..... G06F 1/1616 343/700 MS
7,605,765 B2 * 10/2009 Ku ..... H01Q 1/243 343/700 MS
7,626,551 B2 * 12/2009 Chien ..... H01Q 5/371 343/700 MS
8,009,109 B2 * 8/2011 So ..... H01Q 1/243 343/702
8,054,240 B2 * 11/2011 Honda ..... H01Q 9/40 343/702
8,471,771 B2 * 6/2013 Su ..... H01Q 1/243 343/700 MS
8,587,485 B2 * 11/2013 Tahk ..... H01Q 1/243 343/702
8,618,989 B2 * 12/2013 Sung ..... B29C 45/14065 343/702
8,624,783 B2 * 1/2014 Kim ..... H01Q 1/243 343/700 MS
8,643,547 B2 * 2/2014 Hong ..... B29C 45/1671 29/600
8,773,314 B2 * 7/2014 Hong ..... B29C 45/1671 343/702
8,933,844 B2 * 1/2015 Hong ..... B29C 45/14065 343/700 MS
9,035,847 B2 * 5/2015 Hong ..... B29C 45/14065 343/702
9,136,594 B2 * 9/2015 Shi ..... H01Q 9/0421
9,306,269 B2 * 4/2016 Jouanlanne ..... H01Q 1/243
9,381,688 B2 * 7/2016 Lim ..... H01Q 1/1207
9,419,326 B2 * 8/2016 Han ..... B29C 45/14065
9,531,066 B2 * 12/2016 An ..... H01Q 1/243
9,673,513 B2 * 6/2017 Hong ..... H01Q 1/243
9,722,299 B2 * 8/2017 Lin ..... H01Q 1/243
9,832,292 B2 * 11/2017 Moon ..... G06F 1/20
9,882,268 B2 * 1/2018 Yi ..... H01Q 1/243
2003/0179144 A1 * 9/2003 Takesako ..... H01Q 1/243 343/702
2006/0139218 A1 * 6/2006 Jang ..... H01Q 1/243 343/702
2006/0139219 A1 * 6/2006 Sadamori ..... H01Q 1/243 343/702
2006/0145934 A1 * 7/2006 Park ..... H01Q 1/243 343/702
2006/0170597 A1 * 8/2006 Kurashima ..... H01Q 1/22 343/700 MS
2006/0270472 A1 * 11/2006 Chen ..... H01Q 1/243 455/575.7
2006/0290591 A1 * 12/2006 Nilsson ..... H01Q 1/1207 343/906
2006/0292934 A1 * 12/2006 Schell ..... H01R 12/7088 439/660
2007/0040755 A1 * 2/2007 Na ..... H01Q 1/243 343/702
2007/0057856 A1 * 3/2007 Na ..... H01Q 1/243 343/702
2007/0063903 A1 * 3/2007 Mun ..... H01Q 1/243 343/702
2007/0139270 A1 * 6/2007 Takei ..... H01Q 1/243 343/700 MS
2007/0216580 A1 * 9/2007 Lin ..... H01Q 1/243 343/702
2008/0074342 A1 * 3/2008 Lindackers ..... H01Q 1/3275 343/906
2009/0002244 A1 * 1/2009 Woo ..... H01Q 1/38 343/702
2009/0015510 A1 * 1/2009 Nakata ..... H01Q 1/243 343/878
2009/0085816 A1 * 4/2009 So ..... H01Q 1/243 343/702
2010/0271265 A1 * 10/2010 Sung ..... B29C 45/14065 343/700 MS
2010/0271270 A1 * 10/2010 Sung ..... B29C 45/14065 343/702
2010/0271272 A1 * 10/2010 Sung ..... H01Q 1/243 343/702
2010/0271283 A1 * 10/2010 Sung ..... B29C 45/14639 343/906
2011/0267243 A1 * 11/2011 Steinkamp ..... H01Q 1/1214 343/713
2011/0316754 A1 * 12/2011 Nam ..... H01Q 1/243 343/702
2012/0001807 A1 * 1/2012 Lee ..... H01Q 1/243 343/702
2012/0176279 A1 * 7/2012 Merz ..... H01Q 1/243 343/702
2012/0229352 A1 * 9/2012 Hsiung ..... H01Q 1/088 343/702
2012/0281384 A1 * 11/2012 Hong ..... B29C 45/14639 361/807
2013/0249744 A1 * 9/2013 Jang ..... H01Q 21/30 343/702
2014/0118219 A1 * 5/2014 Baan Hofman ..... H01Q 1/38 343/906
2014/0340266 A1 * 11/2014 Lin ..... H01Q 1/243 343/702
2015/0050968 A1 * 2/2015 Jeon ..... C25D 5/48 455/575.1
2015/0062847 A1 * 3/2015 Park ..... H05K 3/32 361/760
2015/0236402 A1 * 8/2015 Liu ..... H01Q 1/243 343/702
2015/0270612 A1 * 9/2015 Kang ..... H01Q 9/0407 343/872
2016/0204557 A1 * 7/2016 Kim ..... H01R 24/40 439/578

* cited by examiner (A)

(B)

(A)

(B)

(A)

(B)

(A)

(B)

ANTENNA WITH RADIATOR FIXED BY FUSION, AND MANUFACTURING METHOD THEREOF

CROSS-REFERENCE TO RELATED APPLICATION

This application claims the benefit of Korean Application No. 10-2014-0032916, filed on Mar. 20, 2014, with the Korean Intellectual Property Office, the disclosure of which is incorporated herein by reference.

BACKGROUND OF THE INVENTION

Field of the Invention

The present invention relates to an antenna with a radiator fixed by fusion and a method of manufacturing the same and more particularly, to an antenna with a radiator fixed by fusion, which is capable of improving antenna performance by minimizing the thickness of a case covering the outer surface of the radiator, while achieving high manufacturing convenience and yield of the antenna enclosed by a case of a terminal through double injection.

Description of the Related Art

With advance of mobile communication networks, mobile communication terminals supporting the networks have been continuously developed and antennas of the mobile communication terminals are primarily very important in stably receive services provided by the communication networks.

In particular, the antennas require portability and aesthetics of mobile communication terminals. In addition, existing rod antennas have been replaced with built-in antennas mounted within the mobile communication terminals and various types of built-in antennas ensuring performance comparable to the rod antennas appear.

The existing built-in antennas generally include a carrier (dielectric material) made of plastics, and a radiator which is made of highly-conductive metal and includes a protective layer for the metal.

The above-mentioned built-in antennas are manufactured as follows.

The first method is to manufacture the built-in antennas using typical assembling systems, such as joining the carrier to the radiator by means of fasteners.

However, such assembling systems have a problem in that the radiator has to be bent depending on an external shape of the carrier in the process of joining the radiator to the carrier and accordingly a space is formed between the built-in antenna and a cover of a mobile communication terminal combined to tops of the carrier and the radiator, which may result in low space efficiency.

For the purpose of overcoming this problem, there has been proposed an in-mold type antenna manufacturing system as disclosed in KR Patent Reg. No. 1103124.

In this in-mold type antenna manufacturing system, a radiator is put in a mold for plastic injection, a primary injected product with integrated carrier and radiator is manufactured, and the primary injected product is inserted in a mold for case to manufacture a secondary injected product. This in-mold type antenna manufacturing system is capable of forming a curved surface of the radiator depending on a curved shape of the carrier, thereby preventing a space from being formed between the radiator and the cover.

However, in the in-mold type antenna manufacturing system where the carrier and the radiator are integrally injected in the required mold, a structure for fixing the radiator within the mold has to be prepared within the mold, which may result in increased complexity of the mold and hence increased molding and manufacturing costs.

In addition, there may occur a problem of deviation and deformation of the radiator in the processing of injecting resin through the mold.

To avoid this problem, a mold is used to prevent the radiator from being deviated by being partially moved. However, it is difficult for this mold to produce uniform products due to deviations between productions which may be produced by errors of mechanical movement, which may result in a poor yield and high manufacturing costs due to relatively high expensive mold.

Therefore, the in-mold antennas have a problem of difficulty in guaranteeing uniform quality since the structure and position of the radiator may be deformed in the process of the primary injection.

In addition, when the resin is injected in the process of the secondary injection for the case formation, since the case is again formed on the radiator molded in the carrier, the radiator is buried further away from the external due to an addition of the carrier thickness and the case thickness, which may result in rapid decrease in antenna performance.

In addition, it is difficult to form a complex radiator due to limitation in size and shape of the radiator depending on a shape of mold and the injection process is troublesome, which may result in a low yield and high manufacturing costs.

RELATED TECHNICAL DOCUMENT

Patent Document

KR Patent Reg. No. 10-1103124

SUMMARY OF THE INVENTION

Accordingly, it is an object of the present invention to provide a built-in antenna with uniform quality, which is capable of minimizing an effect by resin inserted in injection by injecting a carrier in which a stepped groove combined to a radiator formed, combining the radiator to the stepped groove, fixing the radiator through fusion of fusion of fusion projections formed in the carrier, and injecting the carrier combined to the carrier and an external case integrally.

It is another object of the present invention to minimize the thickness of a case while guaranteeing antenna performance by making an exposed surface of a radiator continuous to a surface of a carrier with no gap when the radiator is combined to the carrier and hence preventing the radiator from being deviated and deformed in double injection for case formation.

It is still another object of the present invention to significantly improve antenna performance by directly inserting a radiator in an injected carrier so that the radiator can be formed in different and complex shapes to meet multi-band characteristics.

To achieve the above objects, according to an aspect of the invention, there is provided an antenna with a radiator fixed by fusion, which is incorporated in a terminal, including: an antenna part including a 3D-patterned metal radiator which is suitable for band characteristics and has holes for combination with fusion projections, and a carrier having a stepped groove corresponding to the pattern of the metal radiator and the fusion projections formed in the stepped groove, wherein the metal radiator is combined to the stepped groove of the carrier and is fused to the fusion projections; and an external case which is formed on the antenna part to cover an outer surface of the antenna part.

The metal radiator may have the 3D pattern by bending conductive metal deployed through press working.

The depth of the stepped groove of the carrier may be equal to or smaller than the thickness of the metal radiator.

The antenna may further include an additional step which is formed in the vicinity of the fusion projections within the stepped groove and makes the outer surface flush with the fusion projections.

The carrier may be formed by injection molding.

The metal radiator may be combined to the stepped groove with no gap to prevent the metal radiator from being deformed due to resin intrusion in double injection.

The external case may be a rear case of the terminal.

The metal radiator may be buried between the carrier and the external case.

The metal radiator may include a hook-like lock in its planar one side, the carrier includes a jaw corresponding to the lock, and the lock may be exposed out of the carrier and the external case by joining of the lock and the jaw such that the lock is electrically connected to a power feeder of the terminal.

Each of the metal radiator and the carrier may include insertion holes in which one or more contact pins are to be inserted, and is electrically connected to a power feeder of the terminal through the one or more contact pins connected to the power feeder of the terminal.

The metal radiator may include an extension formed by bending a portion of the metal radiator in one side of the metal radiator and is electrically connected to a power feeder of the terminal through the extension.

The metal radiator may be FPCB.

According to another aspect of the invention, there is provided an antenna with a radiator fixed by fusion, which is incorporated in a terminal, including: an antenna part including a 3D-patterned metal or FPCB radiator which is suitable for band characteristics and has holes for combination with fusion projections, and a carrier having a stepped groove corresponding to the pattern of the metal or FPCB radiator and the fusion projections formed in the stepped groove, wherein the metal or FPCB radiator is combined to the stepped groove of the carrier and is fused to the fusion projections.

According to still another aspect of the invention, there is provided a method of manufacturing an antenna with a radiator fixed by fusion, which is incorporated in a terminal, including the steps of: forming a 3D-patterned metal radiator which is suitable for band characteristics and has holes for combination with fusion projections; injecting a carrier having a stepped groove corresponding to the pattern for combination of the radiator and the fusion projections to be inserted in the holes; combining the radiator to the stepped groove of the carrier such that the fusion projections of the carrier are inserted in the holes of the radiator and fusing the fusion projections; and covering outer surfaces of the combined radiator and carrier with an external case.

The step of forming a 3D-patterned metal radiator may include forming a terminal connected to a power feeder of the terminal in one side of the radiator.

The metal radiator may be FPCB.

According to the present invention, since the metal radiator combined to the carrier having the stepped groove corresponding to the fusion projections and the 3D pattern of the metal radiator can be strongly fixed to the carrier with no gap through the fusion and combination of the fusion projections, the resin injected in the process of putting the combined radiator and carrier in a mold for injection of the external case and injecting the external case to cover the outer surfaces of the metal radiator and the carrier can be prevented from intruding between the carrier and the radiator, thereby preventing deviation and deformation of the metal radiator due to the penetration of the resin, achieving a high yield and providing uniform quality of the antenna.

In addition, according to the present invention, the metal radiator can be formed on the carrier separately from the carrier. Accordingly, since only the thickness of the external case on the radiator has an effect on the antenna performance, a distance between the metal radiator and the external can become shorter than that in the conventional in-mold antenna, which can result in guaranteed higher antenna performance.

In addition, according to the present invention, by separately forming and combining the metal radiator and the carrier, an antenna suitable for band characteristics can be manufactured by applying various 3D patterns to the metal radiator, which can result in a high degree of freedom for antenna design and higher antenna performance.

Furthermore, according to the present invention, a typical mold can be employed for carrier injection and the metal radiator is strongly fixed to the carrier with no movement depending on the combination of the metal radiator and the carrier even in the mold of injection of the external case, thereby requiring no expensive mold requiring movement, which can result in significant reduction of costs for antennas.

BRIEF DESCRIPTION OF THE DRAWINGS

The above and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENT

Exemplary embodiments of the present invention will be described with reference to the drawings.

Figure 1:
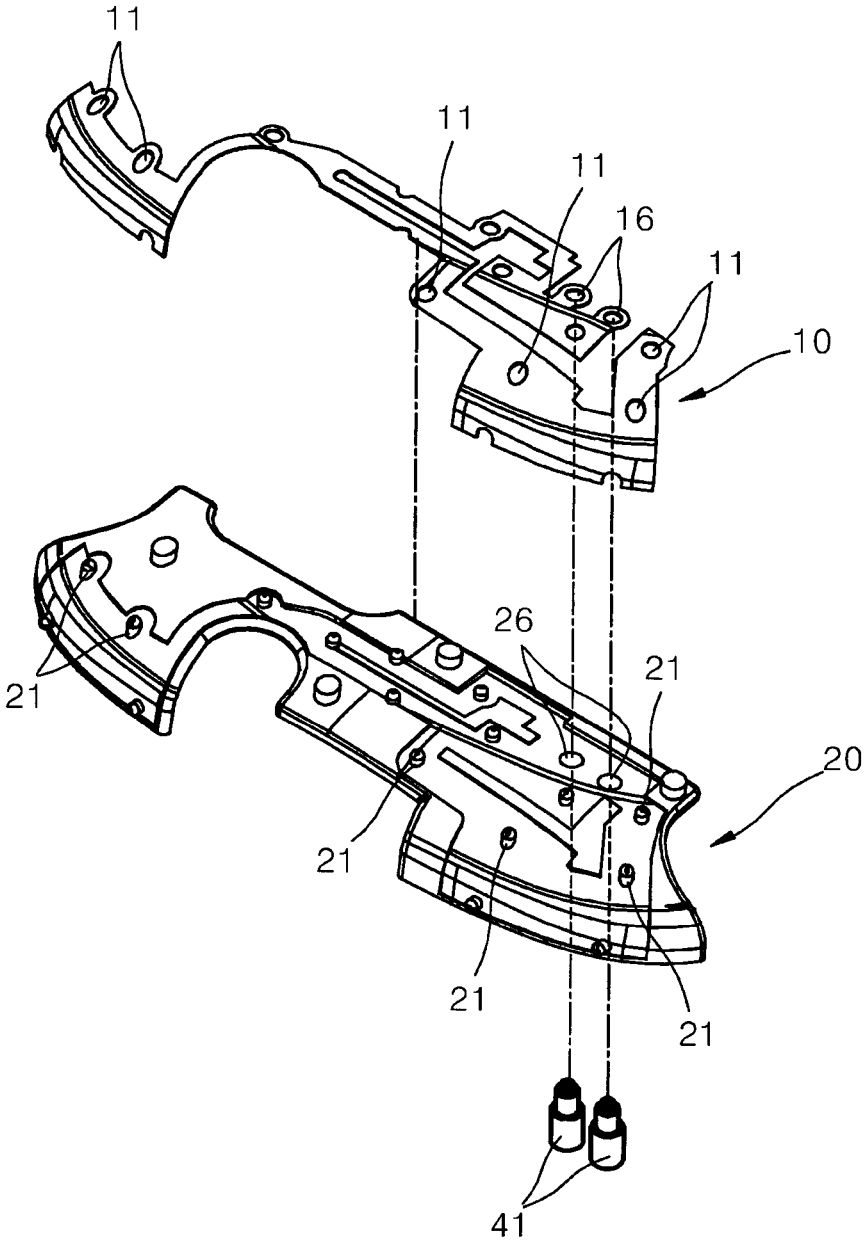
FIG. 1 is a perspective view of an antenna with a radiator fixed by fusion according to an embodiment of the present invention.

FIG. 1 is a perspective view of an antenna with a radiator fixed by fusion according to an embodiment of the present invention. The antenna with the radiator fixed fusion according to the embodiment of the present invention is incorporated in a terminal. As shown, the antenna may include a 3D-patterned metal radiator 10 which is suitable for band characteristics and has one or more holes 11 to be combined with fusion projections 21, and a carrier 20 which has a stepped groove corresponding to the 3D pattern of the radiator 10 and includes one or more fusion projections 21 formed in the stepped groove.

The metal radiator 10 may be formed to have the 3D pattern by bending conductive metal deployed through press work and the holes 11 to be combined with the fusion projections 21 may be formed through piercing work.

The stepped groove corresponding to the 3D pattern for combination with the radiator 10 may be formed by injecting resin in a mold for the carrier 20 and the carrier 20 having the fusion projections 21 to be inserted in the holes 11 may be injected.

Thus, the metal radiator 10 may be combined with the stepped groove of the injected carrier 20 to form the antenna and the fusion projections 21 of the carrier 20 may be inserted in the holes 11 of the metal radiator 10.

In addition, one or more insertion holes 16 and 26 in which one or more contact pins 41 to be connected to a power feeder of the terminal can be inserted may be formed in portions of the metal radiator 10 and the carrier 20. When the contact pins 41 are inserted in the insertion holes 16 and 26 of the combined metal radiator 10 and carrier 20, the metal radiator 10 can be electrically connected to the power feeder of the terminal for signal exchange through the metal radiator 10.

Figure 2:
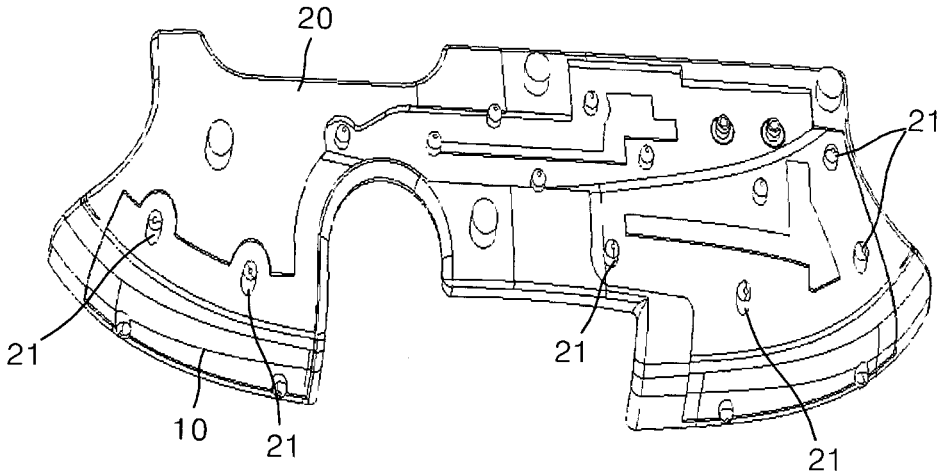
FIGS. 2A and 2B are a plan view and a bottom view of the antenna with the radiator fixed by fusion, respectively, according to the embodiment of the present invention.
Figure 2:
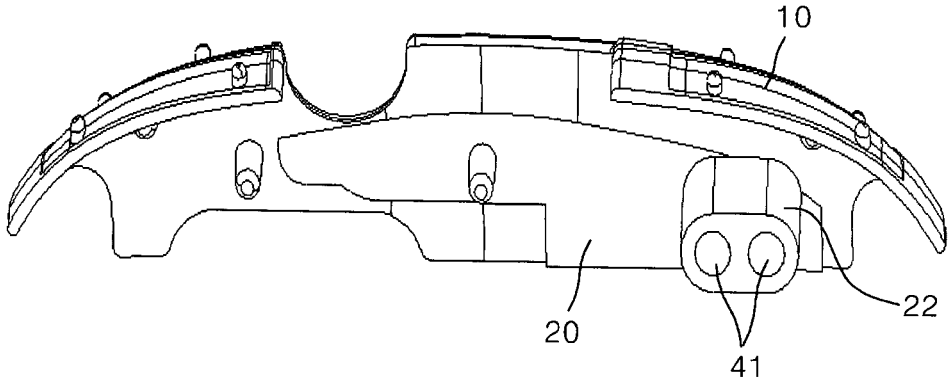

FIGS. 2A and 2B are a plan view and a bottom view of the antenna shown in FIG. 1, respectively, according to the embodiment of the present invention.

As shown, the antenna is formed of the metal radiator 10 combined with the stepped groove of the carrier 20. The metal radiator 10 may be fixed to the stepped groove of the carrier 20 by fusing the fusion projections 21 of the carrier 20 inserted in the metal radiator 10 after the metal radiator 10 is combined with the stepped groove of the carrier 20.

The depth of the stepped groove of the carrier 20 may be equal to or smaller than the thickness of the metal radiator 10. The metal radiator 10 may be formed to be combined with the stepped groove of the carrier 20 with no gap.

If the depth of the stepped groove is equal to the thickness of the metal radiator 10, an outer side of the metal radiator 10 may be continuous to an outer side of the carrier 20 with no step. That is, the outer side of the metal radiator 10 may match the outer side of the carrier 20 to form a curved surface.

An additional step to make the outer sides of the metal radiator 10 and the carrier 20 flush with the fusion projections 21 may be formed around the fusion projections 21 within the stepped groove. This allows a fusion surface of the fusion projections 21 to be continuous to the outer sides with no step when the fusion projections 21 are fused.

In addition to fixing the metal radiator 10 to the carrier 20 through the fusion of the fusion projections 21, the metal radiator 10 may be combined with the stepped groove corresponding to the 3D pattern and thickness of the metal radiator 10 so that the metal radiator 10 cannot be moved on the carrier 20, thereby allowing the metal radiator 10 to be strongly fixed to the carrier 20 with no gap.

In addition, a support structure 22 to support the contact pins 41 inserted in the insertion holes 16 and 26 may be combined to a lower portion of the carrier. The support structure 22 may be formed such that the contact pins 41 inserted through the insertion holes 16 and 26 are strongly fixed. In addition, the support structure 22 may be formed such that one side of the contact pins 41 is externally exposed to provide electric connection between the contact pins 41 and the power feeder of the terminal, thereby allowing a feed current to flow into the metal radiator 10.

Figure 3:
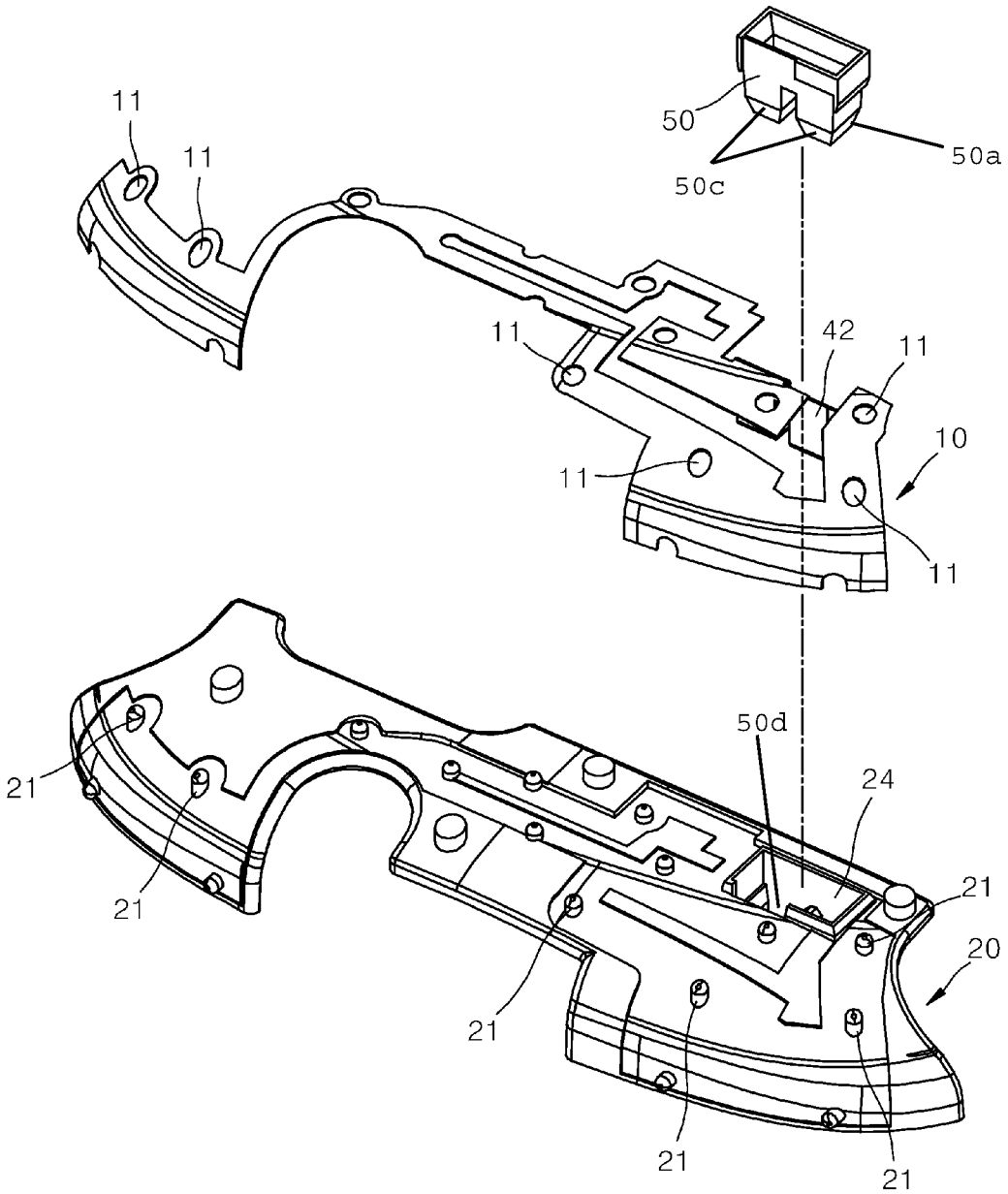
FIG. 3 is a perspective view of an antenna with a radiator fixed by fusion, according to another embodiment of the present invention.

FIG. 3 is a perspective view of an antenna according to another embodiment of the present invention. As shown, the antenna according to another embodiment of the present invention may include a 3D-patterned metal radiator 10 which is suitable for band characteristics and has one or more holes 11 to be combined with fusion projections 21, and a carrier 20 which has a stepped groove corresponding to the 3D pattern of the metal radiator 10 and includes one or more fusion projections 21 formed in the stepped groove, as in the earlier-described embodiment.

The metal radiator 10 may be combined and fixed to the stepped groove of the carrier 20 and may fix the metal radiator 10 to the carrier 20 more strongly through fusion of the fusion projections 21 inserted in the holes 11.

The metal radiator 10 may include a presser foot-like extension 42 formed at one side by bending a portion of the metal radiator 10. An insertion structure 24 in which the extension 42 is inserted may be formed in a portion of the carrier 20. When the metal radiator is combined to the stepped groove of the carrier 20, the extension 42 may be inserted in the insertion structure 24.

Thus, when the extension 42 is inserted in the insertion structure 24, one side of the extension 42 can be exposed out of the insertion structure 24 and accordingly can be electrically connected to the power feeder of the terminal.

A feed current can flow into the metal radiator 10 through the extension 42 electrically connected to the power feeder of the terminal and the metal radiator 10 can act as an antenna accordingly.

In addition, a fixed structure 50 to fix the extension 42 to the insertion structure 24 of the carrier 20 strongly may be formed to be combined to a fixed groove formed by the insertion of the extension 42 in the insertion structure. Accordingly, the extension 42 can be strongly fixed to the carrier 20 through the engagement of the fixed structure taper 50*a* two prongs 50*c* and the insertion structure mating taper 50*b* two mating sockets 50*d*.

Figure 4:
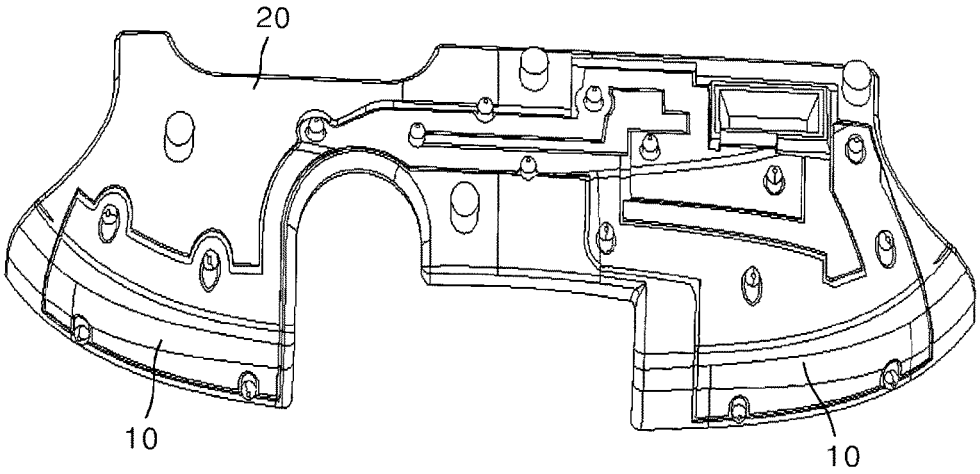
FIGS. 4A and 4B are a plan view and a bottom view of an antenna with a radiator fixed by fusion, respectively, according to the another embodiment of the present invention.
Figure 4:
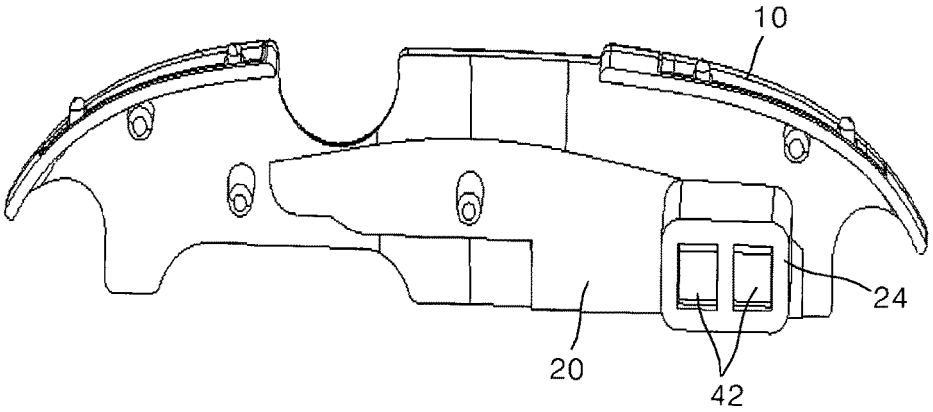

FIGS. 4A and 4B are a plan view and a bottom view of the antenna shown in FIG. 3, respectively, according to the embodiment of the present invention.

As shown, the antenna includes the metal radiator 10 combined to the stepped groove of the carrier 20. The metal radiator 10 may be formed to be fixed to the stepped groove of the carrier 20 by fusing the fusion projections 21 of the carrier 20 inserted in the metal radiator 10 after the metal radiator 10 is combined to the stepped groove of the carrier 20.

The extension 42 may be formed to be inserted in the insertion structure 24 formed in the carrier 20 when the metal radiator 10 is combined to the carrier 20. One side of the extension 42 can be exposed out of the insertion structure 24 and accordingly can be electrically connected to the power feeder of the terminal, thereby allowing a feed current to flow into the metal radiator 10.

Figure 5:
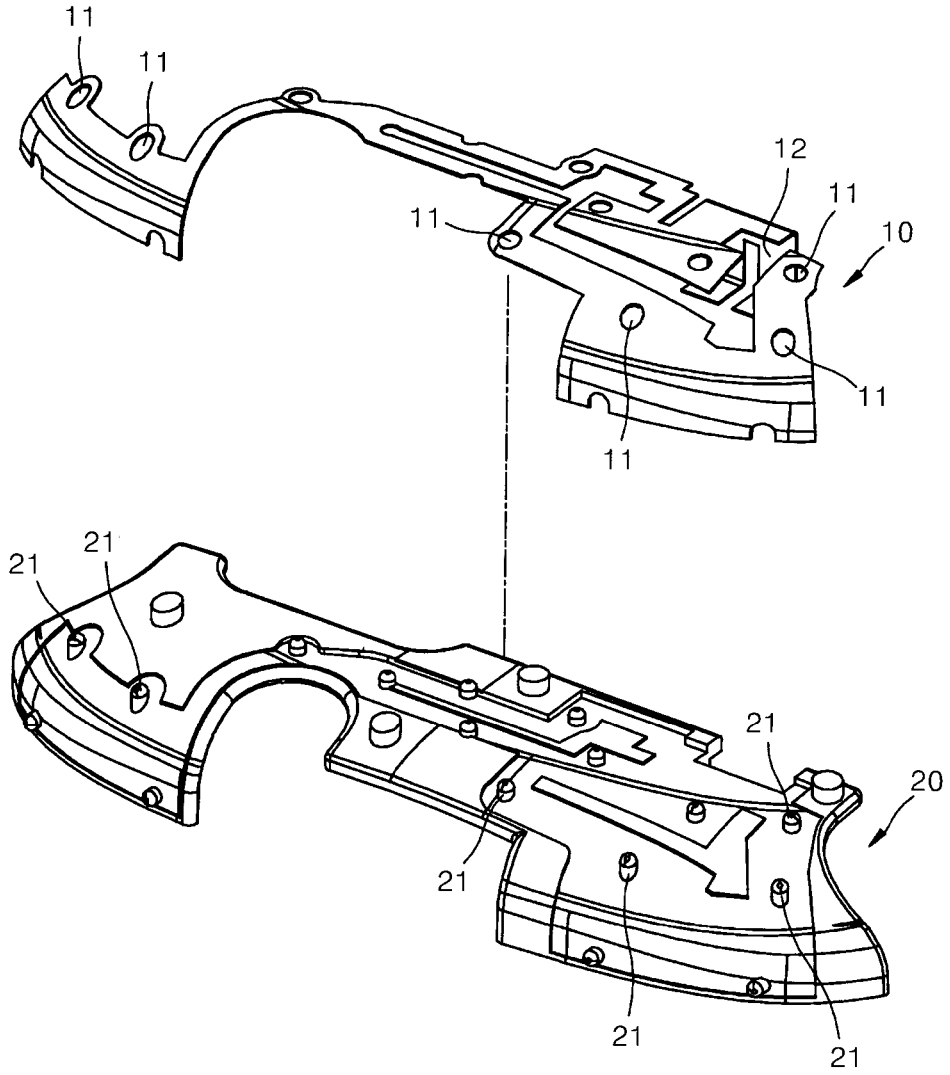
FIG. 5 is a perspective view of an antenna with a radiator fixed by fusion, according to still another embodiment of the present invention.

FIG. 5 is a perspective view of an antenna according to still another embodiment of the present invention. As shown, the antenna according to still another embodiment of the present invention may include a 3D-patterned metal radiator 10 which is suitable for band characteristics and has one or more holes 11 to be combined with fusion projections 21, and a carrier 20 which has a stepped groove corresponding to the 3D pattern of the metal radiator 10 and includes one or more fusion projections 21 formed in the stepped groove, as in the earlier-described embodiments.

The metal radiator 10 may be combined and fixed to the stepped groove of the carrier 20 and may fix the metal radiator 10 to the carrier 20 more strongly through fusion of the fusion projections 21 inserted in the holes 11.

The metal radiator 10 may include a hook-like lock 12 formed at one side by bending a portion of the metal radiator 10, as shown. A jaw joining with the lock 12 is formed below the carrier 20. When the metal radiator 10 is combined to the stepped groove of the carrier 20, the lock 12 can join with the jaw.

Thus, when the lock 12 joins with the jaw, one side of the lock 12 can be exposed out of the carrier 20 and accordingly can be electrically connected to the power feeder of the terminal.

A feed current can flow into the metal radiator 10 through the lock 12 electrically connected to the power feeder of the terminal and the metal radiator 10 can act as an antenna accordingly.

Figure 6:
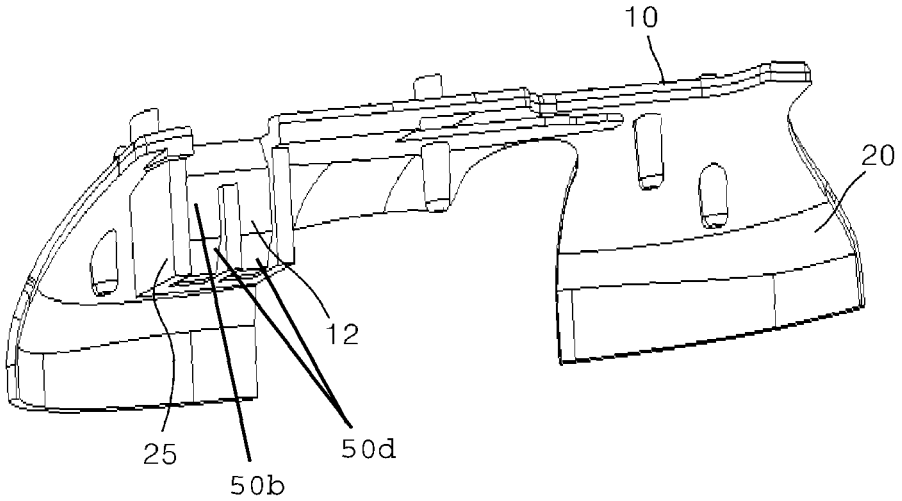
FIGS. 6A and 6B are a rear view and a bottom view of the antenna with the radiator fixed by fusion, respectively, according to the another embodiment of the present invention.
Figure 6:
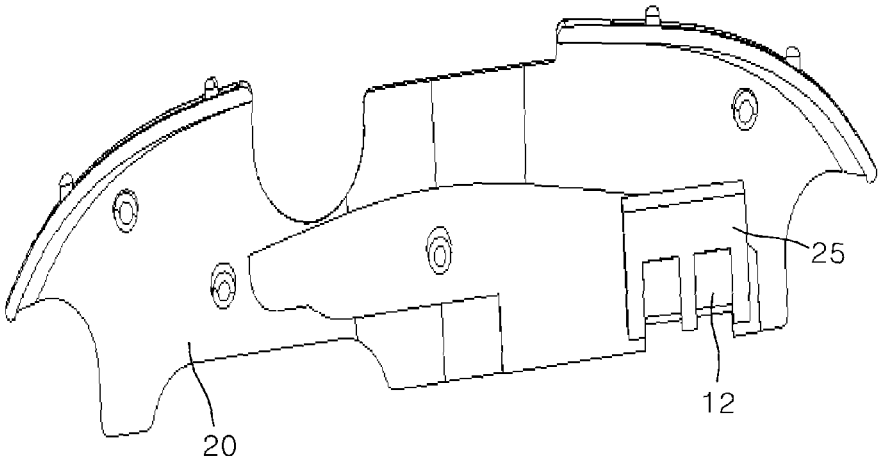

FIGS. 6A and 6B are a rear view and a bottom view of the antenna shown in FIG. 5, respectively, according to the embodiment of the present invention.

As shown, the antenna includes the metal radiator 10 combined to the stepped groove of the carrier 20. The metal radiator 10 may be formed to be fixed to the stepped groove of the carrier 20 by fusing the fusion projections 21 of the carrier 20 inserted in the metal radiator 10 after the metal radiator 10 is combined to the stepped groove of the carrier 20.

The lock 12 may be formed to join with the jaw 25 formed in the carrier 20 when the metal radiator 10 is combined to the stepped groove of the carrier 20. The lock 12 can be exposed out of the bottom of the carrier 20 when the lock 12 joins with the jaw 25.

Accordingly, one side of the lock 12 can be electrically connected to the power feeder of the terminal, thereby allowing a feed current to flow into the metal radiator 10 through the lock 12.

Figure 7:
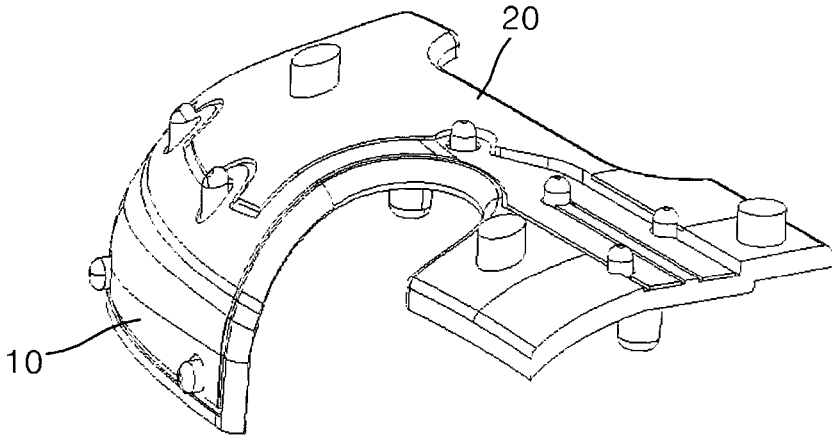
FIG. 7 is a sectional view showing a configuration of an antenna with a radiator fixed by fusion, which further includes an external case, according to an embodiment of the present invention.
Figure 7:
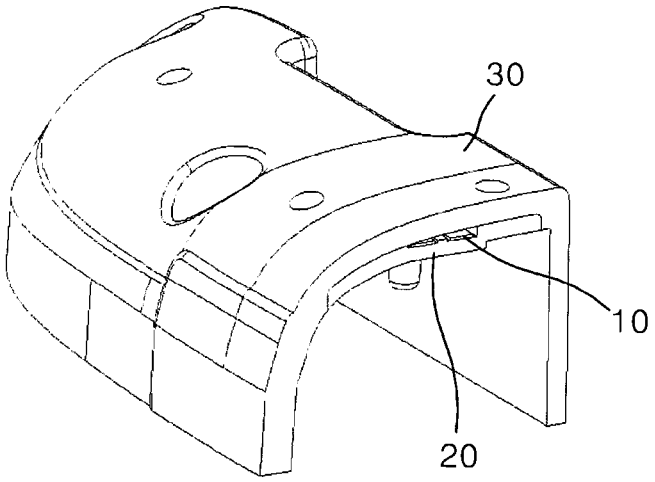

FIG. 7 is a sectional view showing a configuration of an antenna with a radiator fixed by fusion, which further includes an external case, according to an embodiment of the present invention. The antenna with the radiator fixed by fusion according to the embodiment of the present invention may include a metal radiator 10 shown in any one of FIGS. 1 to 6, a carrier 20 formed on the metal radiator 10, and an external case 30 covering the outer surface of the metal radiator 10.

In more detail, according to the configuration of FIGS. 1 to 6, the metal radiator 10 combined to the stepped groove of the carrier 20 as shown in FIG. 7A may be formed by molding for injection of the external case such that the external case 30 covers the metal radiator 10 as shown in FIG. 7B.

The metal radiator 10 may be formed such that all portions except a constituent portion connected to the power feeder of the terminal is buried between the carrier 20 and the external case 30.

Thus, as shown in FIG. 7B, the external case 30 may be formed to cover the outer surface of the antenna including the carrier 20 and the metal radiator 10. The external case 30 may be constituted by a rear case of the terminal.

In the process of forming the external case 30 to cover the outer surface of the antenna, the interior of the insertion structure 24 formed in the carrier 30 shown in FIG. 3 may be filled with resin. Accordingly, the presser foot-like extension 42 inserted in the insertion structure may be fixed by the resin filled in the insertion structure 24 without the fixed structure 50.

The above-described antenna with the radiator fixed by fusion according to the embodiment of the present invention can be manufactured to provide the 3D-patterned metal radiator formed through working, separately from the carrier. In addition, the carrier can be easily injected to provide the stepped groove corresponding to the 3D pattern of the metal radiator, so that the metal radiator can be combined to the stepped groove of the carrier with no gap.

On the other hand, a conventional in-mold antenna may produce a space between the carrier and the metal radiator in the process of injecting the 3D-patterned metal radiator and the carrier and resin may penetrate into the space in the process of injecting the antenna including the carrier and the metal radiator through a mold for injection of the external case. Therefore, the 3D pattern may be deformed and the resin may push the metal radiator to deviate the metal radiator from its original position. This may result in a low yield and a difference in antenna performance between products.

In contrast, in the present invention, as described above, the metal radiator can be combined and fixed to the stepped groove of the carrier without no gap by the fusion of the fusion projections in the process of putting the antenna in a mold for injection of the external case and injecting the external case to cover the outer surface of the antenna. Therefore, a space into which resin input in the mold for injection penetrates is not produced between the metal radiator and the carrier, thereby preventing deviation and deformation of the metal radiator due to the penetration of the resin. This can result in a high yield, guaranteed performance of the antenna covered with the external case, and uniform quality of the antenna.

In addition, the external case can be formed to have a curved surface depending on a curved shape of the outer surface of the antenna through double injection and can be injected to cover the outer surface of the antenna with the external case, thereby preventing a space from being produced between the metal radiator and the cover.

In addition, in the present invention, the metal radiator and the carrier can be separately formed and combined to each other, thereby providing an antenna with the metal radiator which has various 3D patterns and is suitable for band characteristics. This can result in a higher degree of freedom for antenna design and higher performance of the antenna.

In addition, in the present invention, the carrier can be injected using a typical mold and the metal radiator can be strongly fixed to the carrier with no movement depending on the combination of the metal radiator and the carrier in molding for injection of the external case. This can result in significant reduction in costs required for manufacture of the antenna without requiring an expensive movable mold used to prevent deviation and deformation of conventional radiators.

Moreover, in the present invention, the carrier can be formed separately from the metal radiator to form the antenna on the carrier, unlike the conventional in-mold antenna where a distance between the metal radiator and the external increases due to addition of the thickness of the carrier and the thickness of the external case on the metal radiator by being injected with a structure where the metal radiator is buried in the carrier and then the carrier is covered by the external case through injection, which may result in poor antenna performance of the metal radiator. Therefore, since only the thickness of the external case on the metal radiator has an effect on the antenna performance, a distance between the metal radiator and the external becomes smaller than that of the conventional in-mold antenna, which can result in higher antenna performance.

Figure 8:
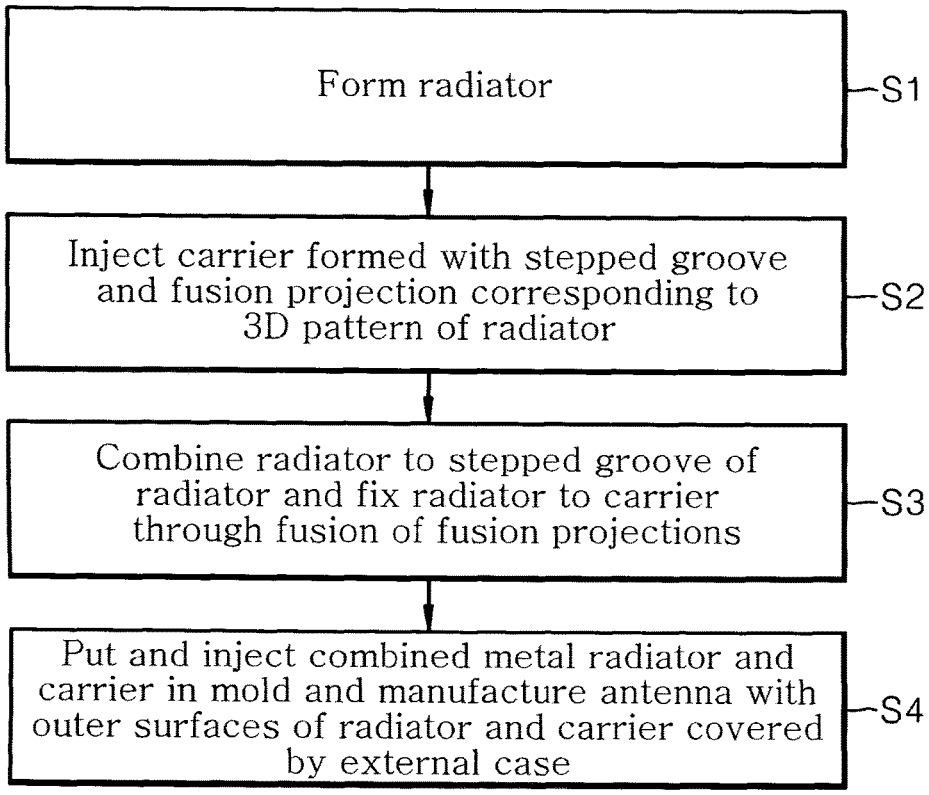
FIG. 8 is a flow chart for explaining a method of manufacturing an antenna with a radiator fixed by fusion according to an embodiment of the present invention.

FIG. 8 is a flow chart for explaining a method of manufacturing an antenna with a radiator fixed by fusion according to an embodiment of the present invention.

First, a 3D-patterned metal radiator made of conductive metal which is suitable for band characteristics and has holes for combination with fusion projections is formed (S1).

Thus, a metal radiator having various 3D patterns and high complexity depending on the band characteristics can be easily manufactured.

Thereafter, a stepped groove is formed to correspond to the patterns for combination with the metal radiator and a carrier having fusion projections to be inserted in the holes (S2).

Next, the metal radiator is combined to the stepped groove of the carrier such as the fusion projections of the carrier are inserted in the holes of the metal radiators, and the fusion projections are fused (S3).

At this time, since the carrier is injected separately from the metal radiator and is combined to the stepped groove of the injected carrier the metal radiator such that the outer surface of the metal radiator is entirely exposed, it is possible to improve the antenna performance.

Thereafter, the combined metal radiator and carrier are put in a mold for injection of the external case and are double-injected to cover the outer surface of the combined metal radiator and carrier with the external case, thereby achieving the antenna according to the embodiment of the present invention (S4). In addition, since the outer surface of the metal radiator is covered by only the external case, the antenna performance is affected by only the thickness of the external case, which can result in a minimized distance between the metal radiator and the external and hence significant improvement of the antenna performance over the conventional in-mold antenna.

In addition, since the resin is prevented from pushing into the metal radiator in the double injection for the external case when the carrier is combined to the metal radiator, the 3D pattern of the metal radiator can be prevented from deformed and deviated from its original position, which can result in great improvement of an antenna yield and uniform quality of the antenna.

Further, the contact terminal corresponding to the presser foot-like extension shown in FIG. 3 or the hook-like lock shown in FIG. 5 connected to the power feeder of the terminal can be formed in one side of the metal radiator in the process of forming the metal radiator.

Moreover, in the embodiments of the present invention shown in FIGS. 1 to 8, the metal radiator may be replaced with FPCB (Flexible Printed Circuit Board).

Therefore, like the metal radiator, the FPCB can be bent to be easily combined to the stepped groove of the carrier and fusion projections can be inserted in and fused to the holes.

With this configuration, since the FPCB can be combined to the stepped groove of the carrier with no gap and can be fixed to the carrier with no gap by fusion of the fusion projections, like the metal radiator, it is possible to prevent resin from intruding between the FPCB and the carrier in the process of double injection, like the metal radiator and the carrier, thereby preventing deviation and deformation of the FPCB and achieving a high yield and uniform quality of the antenna.

While the present invention has been particularly shown and described with reference to exemplary embodiments thereof, it will be understood by those skilled in the art that various changes in form and details may be made therein without departing from the spirit and scope of the present invention. The exemplary embodiments are provided for the purpose of illustrating the invention, not in a limitative sense. Thus, it is intended that the present invention covers the modifications and variations of this invention provided they come within the scope of the appended claims and their equivalents.

What is claimed is:

1. An antenna with a radiator fixed by fusion, which is incorporated in a terminal, comprising:

an antenna part including a 3D-patterned metal radiator which is suitable for band characteristics and has holes for combination with fusion projections, wherein the 3D-patterned metal radiator includes an extension formed by bending a portion of the 3D-patterned metal radiator in one side of the 3D-patterned metal radiator;

a carrier having a stepped groove corresponding to the pattern of the metal radiator and the fusion projections formed in the stepped groove, wherein the metal radiator is combined with the stepped groove of the carrier and is fused to the fusion projections;

an insertion structure formed in a portion of the carrier, wherein when the 3D-patterned metal radiator is combined with the stepped groove of the carrier, the extension is inserted in the insertion structure;

a tapered fixed structure having two tapered mating prongs that engage the extension to the insertion structure of the carrier, wherein the two tapered mating prongs engage two tapered sockets of the insertion structure; and an external case which is formed on the antenna part to cover an outer surface of the antenna part.

2. The antenna according to claim 1, wherein the 3D-patterned metal radiator has the 3D pattern by bending conductive metal deployed through press working.

3. The antenna according to claim 1, wherein a depth of the stepped groove of the carrier is equal to or smaller than a thickness of the 3D-patterned metal radiator.

4. The antenna according to claim 1, further comprising an additional step which is formed in a vicinity of the fusion projections within the stepped groove and makes the outer surface flush with the fusion projections.

5. The antenna according to claim 1, wherein the carrier is formed by injection molding.

6. The antenna according to claim 1, wherein the 3D-patterned metal radiator is combined to the stepped groove with no gap to prevent the 3D-patterned metal radiator from being deformed due to resin intrusion in double injection.

7. The antenna according to claim 1, wherein the external case is a rear case of the terminal.

8. The antenna according to claim 1, wherein the 3D-patterned metal radiator is buried between the carrier and the external case.

9. The antenna according to claim 1, wherein the 3D-patterned metal radiator includes a lock in its planar one side, the carrier includes a jaw corresponding to the lock, and the lock is exposed out of the carrier and the external case by joining of the lock and the jaw such that the lock is electrically connected to a power feeder of the terminal.

10. The antenna according to claim 1, wherein one side of the extension is exposed out of the insertion structure for electrical coupling to a power feeder of the terminal through the extension.

11. The antenna according to claim 1, wherein the 3D-patterned metal radiator is FPCB.

12. An antenna with a radiator fixed by fusion, which is incorporated in a terminal, comprising:

an antenna part including a 3D-patterned metal or FPCB radiator which is suitable for band characteristics and has holes for combination with fusion projections, wherein the 3D-patterned metal or the FPCB radiator includes an extension formed by bending a portion of the 3D-patterned metal or the FPCB radiator in one side of the 3D-patterned metal or the FPCB radiator;

a carrier having a stepped groove corresponding to the 3D-patterned of the metal or FPCB radiator and the fusion projections formed in the stepped groove, wherein 3D-patterned of the metal or FPCB radiator is combined to the stepped groove of the carrier and is fused to the fusion projections;

an insertion structure formed in a portion of the carrier;

a tapered fixed structure having two tapered mating prongs that engage the extension to the insertion structure of the carrier, wherein the two tapered mating prongs engage tapered mating sockets of the insertion structure; and wherein when the 3D-patterned metal or the FPCB radiator is combined with the stepped groove of the carrier, the extension is inserted in the insertion structure, and wherein one side of the extension is exposed out of the insertion structure for electrical coupling to a power feeder of the terminal through the extension.

13. A method of manufacturing an antenna with a radiator fixed by fusion, which is incorporated in a terminal, comprising the steps of:

forming a 3D-patterned metal radiator which is suitable for band characteristics and has holes for combination with fusion projections, wherein the 3D-patterned metal radiator includes an extension formed by bending a portion of the 3D-patterned metal radiator in one side of the 3D-patterned metal radiator;

injecting a carrier having a stepped groove corresponding to the pattern for combination of the radiator and the fusion projections to be inserted in the holes;

combining the radiator to the stepped groove of the carrier such that the fusion projections of the carrier are inserted in the holes of the radiator and fusing the fusion projections, wherein an insertion structure is formed in a portion of the carrier;

combining the 3D-patterned metal radiator with the stepped groove of the carrier to insert the extension in the insertion structure;

inserting a tapered fixed structure having two tapered mating prongs that engage the extension to the insertion structure of the carrier, wherein the two mating prongs engage tapered mating sockets of the insertion structure; and covering outer surfaces of the combined radiator and carrier with an external case.

14. The method according to claim 13, wherein the step of forming a 3D-patterned metal radiator includes forming a terminal connected to a power feeder of the terminal in one side of the radiator.

15. The method according to claim 13, wherein the 3D-patterned metal radiator is FPCB.

16. The antenna according to claim 12, wherein the 3D-patterned metal or FPCB radiator has the 3D pattern by bending conductive metal deployed through press working.

17. The antenna according to claim 12, wherein a depth of the stepped groove of the carrier is equal to or smaller than a thickness of the 3D-patterned metal or FPCB radiator.

18. The method according to claim 13, wherein the 3D-patterned metal radiator has the 3D pattern by bending conductive metal deployed through press working.

19. The method according to claim 13, wherein a depth of the stepped groove of the carrier is equal to or smaller than a thickness of the 3D-patterned metal radiator.

* * * * *